US006774858B1

(12) United States Patent
Wiesenfarth

(10) Patent No.: US 6,774,858 B1
(45) Date of Patent: Aug. 10, 2004

(54) TAPERED, FOLDED MONOPOLE ANTENNA

(75) Inventor: Hans J. Wiesenfarth, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 829 days.

(21) Appl. No.: 09/061,392

(22) Filed: Apr. 16, 1998

(51) Int. Cl.[7] ..... H01Q 1/48
(52) U.S. Cl. ..... 343/739; 343/845
(58) Field of Search ..... 343/739, 900, 343/893, 880, 826, 737, 709

(56) References Cited

U.S. PATENT DOCUMENTS

| | | | | | |
|---|---|---|---|---|---|
| 3,229,296 | A | * | 1/1966 | Saari | 343/709 |
| 3,697,999 | A | | 10/1972 | Cory et al. | 343/763 |
| 4,115,783 | A | | 9/1978 | Reggia | 343/792 |
| 4,161,736 | A | * | 7/1979 | Goodman | 343/739 |
| 4,200,873 | A | | 4/1980 | Seeley | 343/710 |
| 4,286,271 | A | | 8/1981 | Barbano et al. | 343/792.5 |
| 4,313,121 | A | | 1/1982 | Campbell et al. | 343/790 |
| 4,328,501 | A | | 5/1982 | DeSantis et al. | 343/749 |
| 4,443,803 | A | | 4/1984 | DeSantis et al. | 343/749 |
| 4,527,166 | A | | 7/1985 | Luly | 343/840 |
| 4,608,571 | A | | 8/1986 | Luly | 343/781 P |
| 4,860,020 | A | | 8/1989 | Wong et al. | 343/828 |
| 4,970,524 | A | | 11/1990 | Hens | 343/752 |
| 5,191,351 | A | | 3/1993 | Hofer et al. | 343/895 |
| 5,216,436 | A | | 6/1993 | Hall et al. | 343/895 |

OTHER PUBLICATIONS

Preston E. Law, "Shipboard Antennas", pp 99–105, Artech.

* cited by examiner

*Primary Examiner*—James Clinger
(74) *Attorney, Agent, or Firm*—Allan Y. Lee; Michael A. Kagan; Peter A. Lipovsky

(57) ABSTRACT

A folded monopole antenna uses two vertical monopole antenna elements one of which is tapered and resistively loaded to a ground plane. The tapered vertical monopole antenna element includes a series of operably coupled cylindrical sections that extend from a base end of this element to its top end. The cylindrical sections decrease in diameter from the base end to the top end of this element. The second monopole antenna element has a substantially constant outer diameter. An antenna feed is coupled to this second element. A third antenna element of substantially equivalent diameter to the second element is operably coupled to the top ends of the first and second antenna elements. In both transmitting and receiving modes, the tapered monopole antenna element is considered to cause a cancellation of the electric field from the feeding antenna element and thereby provide a wide range of impedance matching.

14 Claims, 18 Drawing Sheets

TAPERED, FOLDED MONOPOLE ANTENNA

BACKGROUND OF THE INVENTION

This invention relates generally to antennas and more particularly to antennas that operate over a wide frequency range. Most high frequency (HF) communication systems use very large antennas or several smaller antennas to cover the entire HF spectrum (2 to 32 megaHertz (MHZ)). Oil board military ships, where space is at premium, this configuration of antennas poses considerable problems in the form of prohibiting certain deck maneuvers, interfering with weapons systems, and detracting from stealth characteristics.

Another problem for an antenna system designed to operate over a very wide frequency range is the impedance matching of the system with that of a transmitter. In the past, compensating or matching circuits have been designed to be used with an antenna to accomplish impedance matching. Typically, such matching circuits are useful only over a narrow range of frequencies. Hence, for a wideband antenna, a number of such compensators are required as well as an appropriate switching system that permits the proper matching circuit to be used for whatever transmitting impedance is present.

Thus, for at least shipboard applications, it is desirable to have a single antenna apparatus that covers a very wide frequency range and that provides acceptable impedance matching over this frequency range without the need for a myriad of impedance matching circuits and their required switching arrangements.

SUMMARY OF THE INVENTION

The invention accomplishes these goals by utilizing a tapered, folded monopole antenna configuration. In this configuration, one of two vertical monopole antenna elements is tapered and resistively loaded to a ground plane. In a preferred embodiment of the invention the tapered vertical monopole antenna element includes a series of operably coupled cylindrical sections that extend from a base end of this element to its top end. The cylindrical sections decrease in diameter from the base end to the top end of the tapered element. The second monopole antenna element has a substantially constant outer diameter. An antenna feed is coupled to the base of this second element via a transformer. A third antenna element of substantially equivalent diameter to the second element is operably coupled to the top ends of the first and second antenna elements. In both transmitting and receiving modes the tapered monopole antenna element is considered to cause a cancellation of the electric field from the feeding antenna element to thereby provide a wide range of impedance matching. The resistive load applied to the ground isolated tapered antenna element could be replaced by multiple loadings such as those involving R, L, and C components arranged in numerous combinations and embodiments. Besides using a stepwise tapered element, the antenna of the invention could employ a continuously tapered element.

OBJECTS OF THE INVENTION

It is an object of this invention to provide an antenna system suitable for use with communications operating over a very broad band of frequencies.

Another object of this invention is to provide an antenna system suitable for use with communications operating over the entire high frequency band.

Another object of this invention is to provide a single antenna that operates over a very wide frequency band and that provides impedance matching over this wide frequency band.

Another object of this invention is to provide a single antenna in which impedance matching is performed without the need for a multitude of impedance matching circuits.

Another object of the invention is to provide a single antenna in which said impedance matching is provided without the need for band switching circuits.

Other objects, advantages and new features of the invention will become apparent from the following detailed description of the invention when considered in conjunction with the accompanied drawings.

DESCRIPTION OF THE PREFERRED EMBODIMENT

Figure 1:
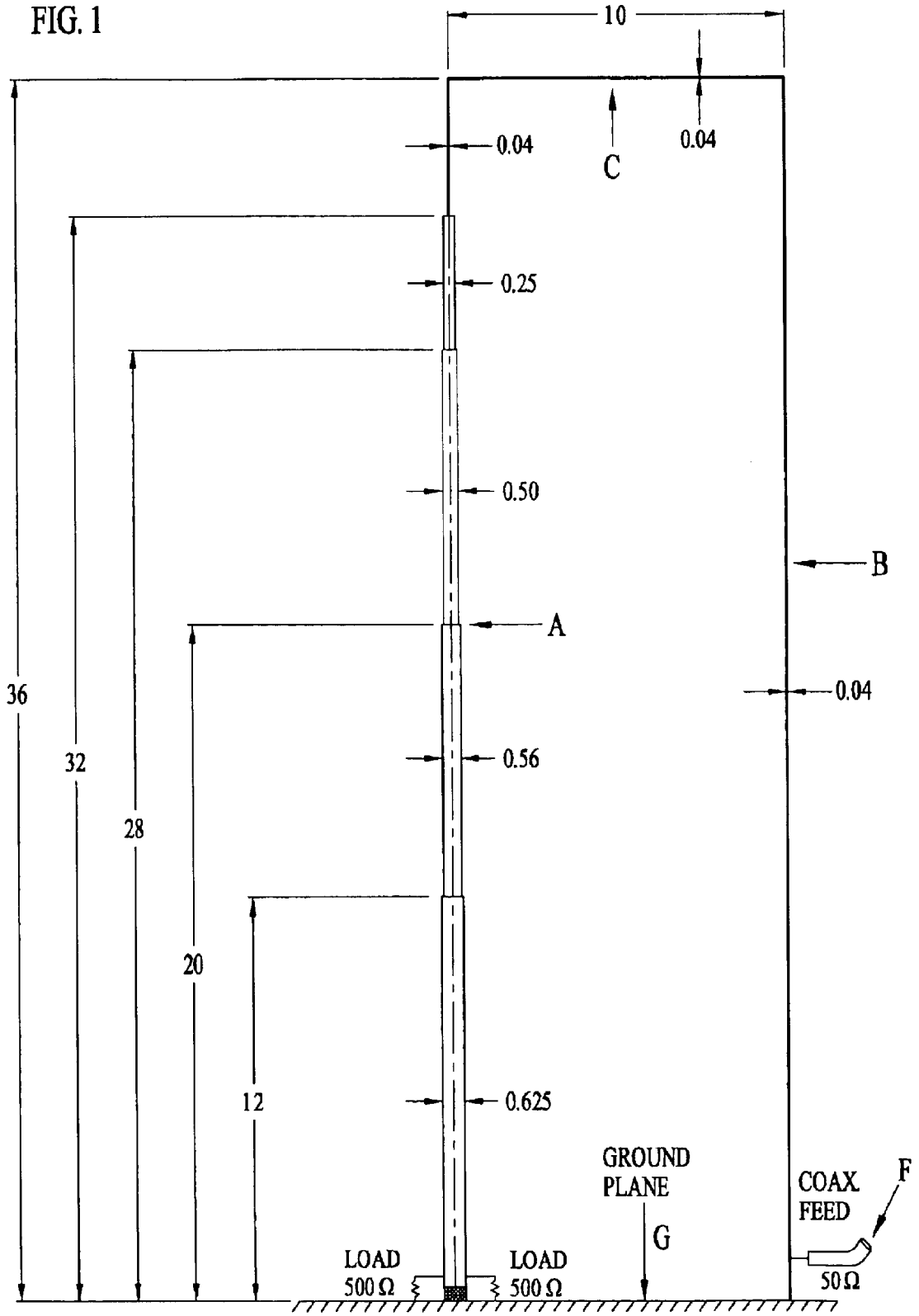
FIG. 1 is a side view of a tapered, folded monopole antenna according to one embodiment of the invention.

Referring now to FIG. 1, an exemplary embodiment of the tapered, folded monopole antenna 10 of the invention is shown. Antenna 10 includes a first substantially vertical monopole antenna element 12 and a second substantially vertical monopole antenna element 14. First monopole antenna element 12 has a base end 12' and a top end 12" and has an outer diameter that decreases between base end 12' and top end 12" in either a stepwise or continuous fashion. Second monopole antenna element 14 has a base end 14' and a top end 14" and is of a substantially uniform diameter or thickness. A third antenna element 16 has an outer diameter that is substantially equal to the outer diameter of second element 14 and is operably coupled to the top ends of the first and second monopole antenna elements.

Folded monopole antenna 10 is mounted on a ground plane 18 that may consist of a solid metal surface such as for shipboard applications or a wire mesh or radio wires for land-based applications. A suitable transformer 19 is utilized to operably couple an antenna feed line 20 to second element 14 and, in the embodiment shown, is also used to operably couple second monopole-antenna element 14 to ground plane 18. Antenna feed line 20 may, for example, be a typical coaxial cable of 50 or 75 Ω or could be a balanced two-wire feed line of 300 Ω. In the design of this invention, no matching network is used at the antenna's feed point 20. First monopole antenna element 12 is electrically isolated from ground plane 18 by base insulator 22. Antenna element 12 is resistively loaded to ground plane 18 such as by, for example, two 500 Ω parallel resistors 24 at the base of element 12. Of course the value of the resistive load may be altered to alter the antenna's efficiency. And, of course, it may be possible to use other single or multiple loadings, such as those involving RLC components, to adjust the antenna's VSWR and efficiency. The location and component values of the RLC loads can be determined, for example, by computer. An applicable computer code designed for this purpose is known as the "Design Algorithm Based on Genetic Algorithms" by Professor Raj Mittra, Director Electromagnetic Communication Laboratory, University of Illinois, Urbana, Ill.

In a representative embodiment of the invention, the overall height of the tapered, folded monopole antenna 10 is approximately 36 feet, with a width between the axes of elements 12 and 14 being 10 feet. In this representative example of the invention, element 12 is constructed of a stepwise taper, beginning with cylindrical section 12A rising to a height of 12 feet and being of 0.625 feet in diameter followed by cylindrical section 12B rising to an over-all height of 20 feet and being 0.56 feet in diameter, followed by cylindrical section 12C rising to an over-all height of 28 feet and being 0.50 feet in diameter, followed by cylindrical section 12D rising to an over-all height of 32 feet and being 0.25 feet in diameter, and culminating in cylindrical section 12E rising to an over-all height of 36 feet and being 0.04 feet in diameter. Antenna elements 14 and 16 are the same thickness or diameter as section 12E of antenna element 12, and antenna element 16 is configured to be substantially horizontal between vertical elements 12 and 14.

The tapered, folded monopole antenna 10 of the above representative configuration was analyzed on a computer using the Numerical Electromagnetics Code, NEC4. This code is otherwise identified as: Numerical Electromagnetics Code-NEC4-Method of Moments Part I: User Manual, 1992, Jerald Burke, Lawrence Livermore Laboratory. This computer analyzation showed that the antenna has a very large frequency bandwidth capable of covering the entire high frequency (HF) band.

Figure 2A:
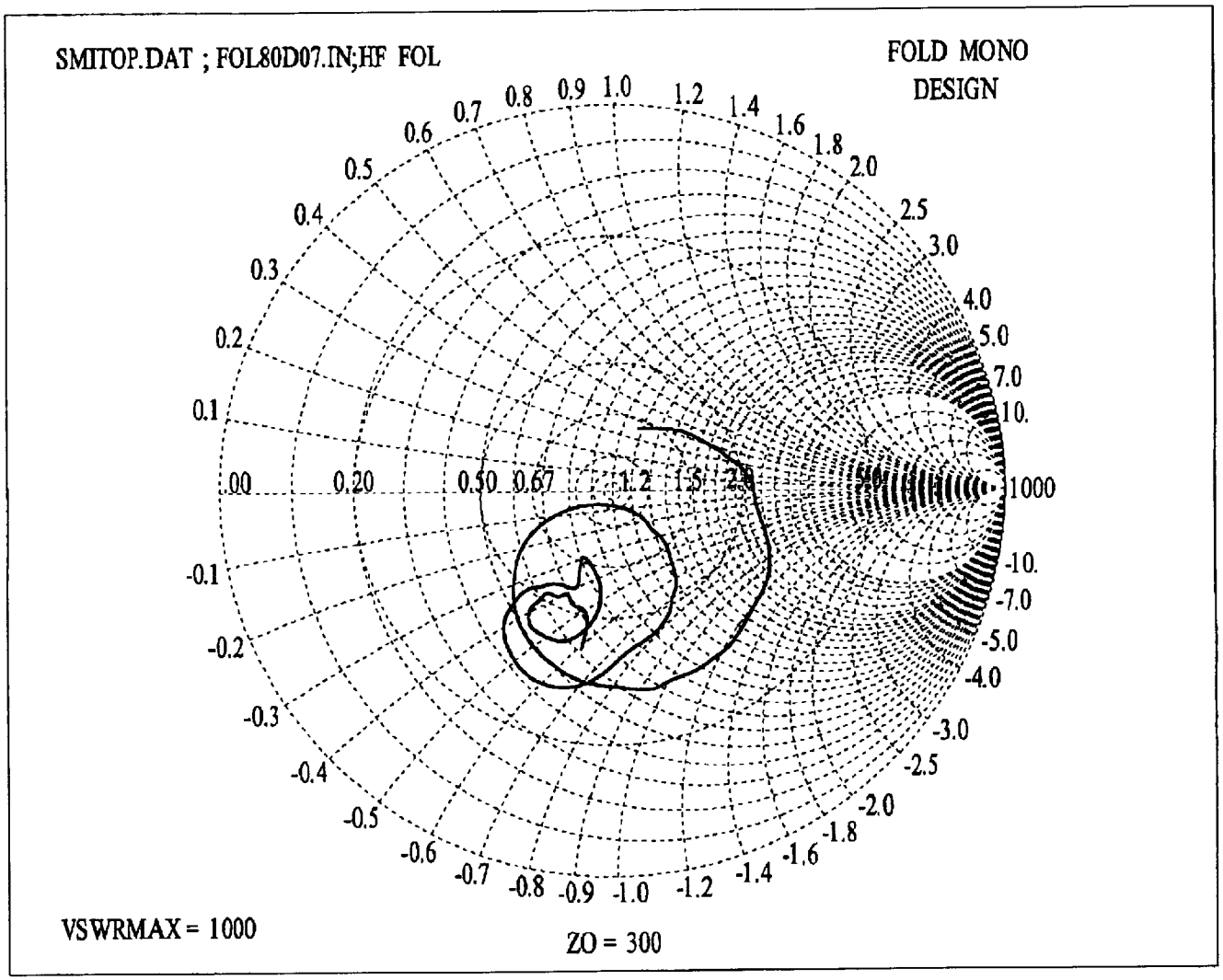
FIG. 2A shows the calculated input impedance on a Smith Chart for one embodiment of the tapered, folded monopole antenna of the invention.
Figure 2B:
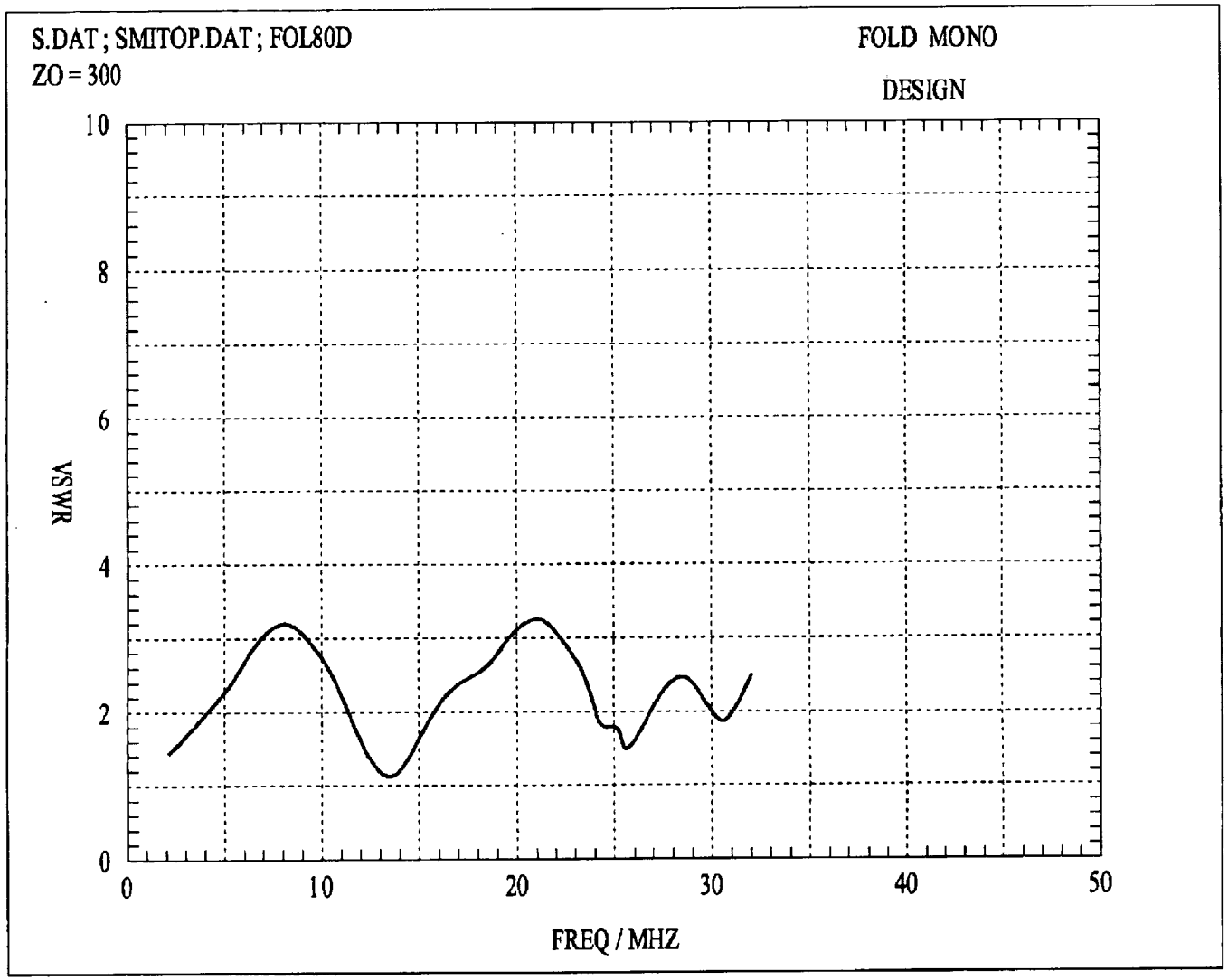
FIG. 2B shows the voltage standing wave ratio (VSWR) from 2 to 32 MHZ as calculated for one embodiment of the invention.

FIG. 2A shows the calculated input impedance on a Smith Chart for this representative antenna and FIG. 2B shows the voltage standing wave ratio (VSWR) for this antenna from 2–32 MHZ. As can be seen from these figures, the antenna of the invention is matched to less than 3:1 over the entire HF band.

Figure 3:
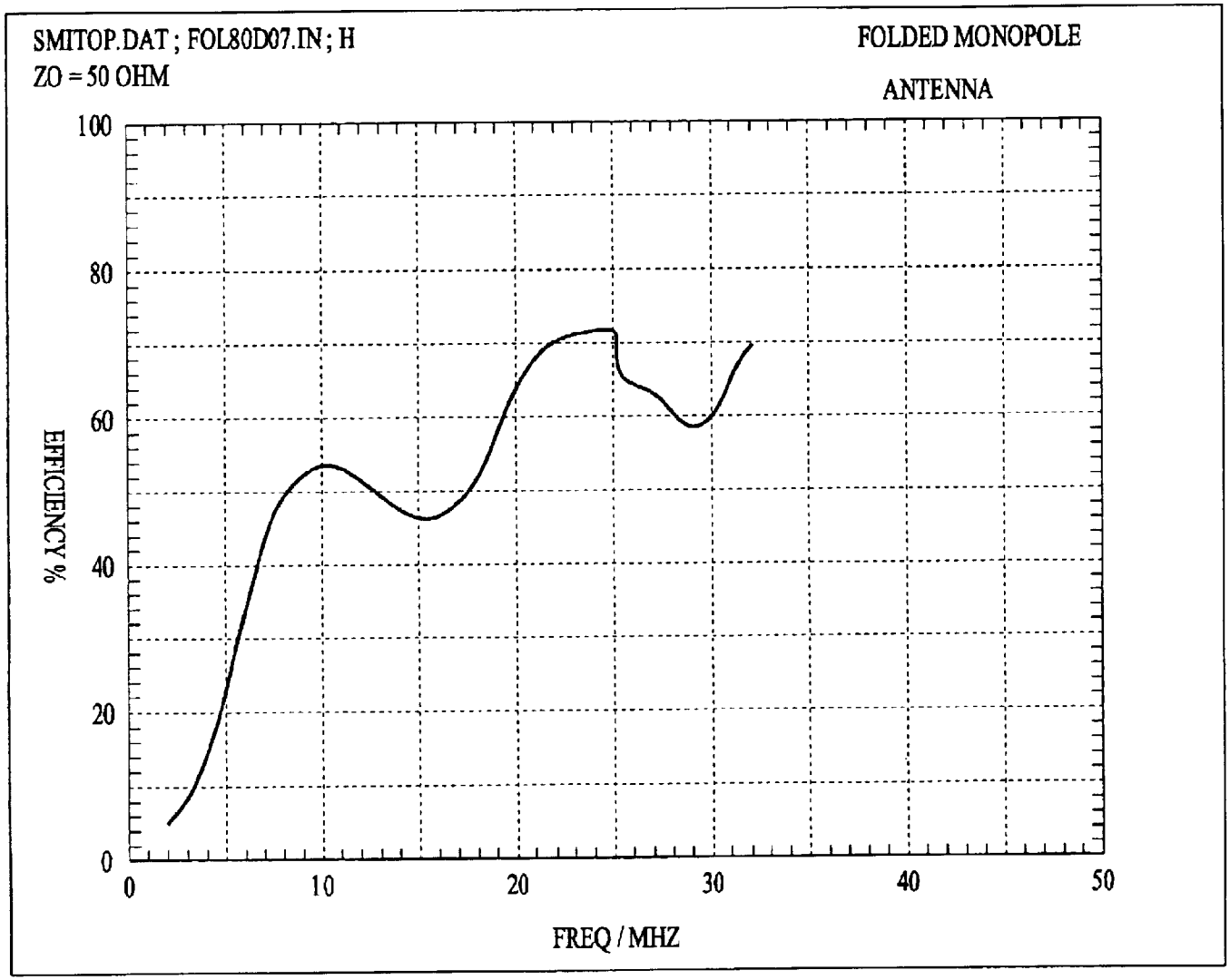
FIG. 3 shows the calculated efficiency for one embodiment of the tapered, folded monopole antenna of the invention.
Figure 4A:
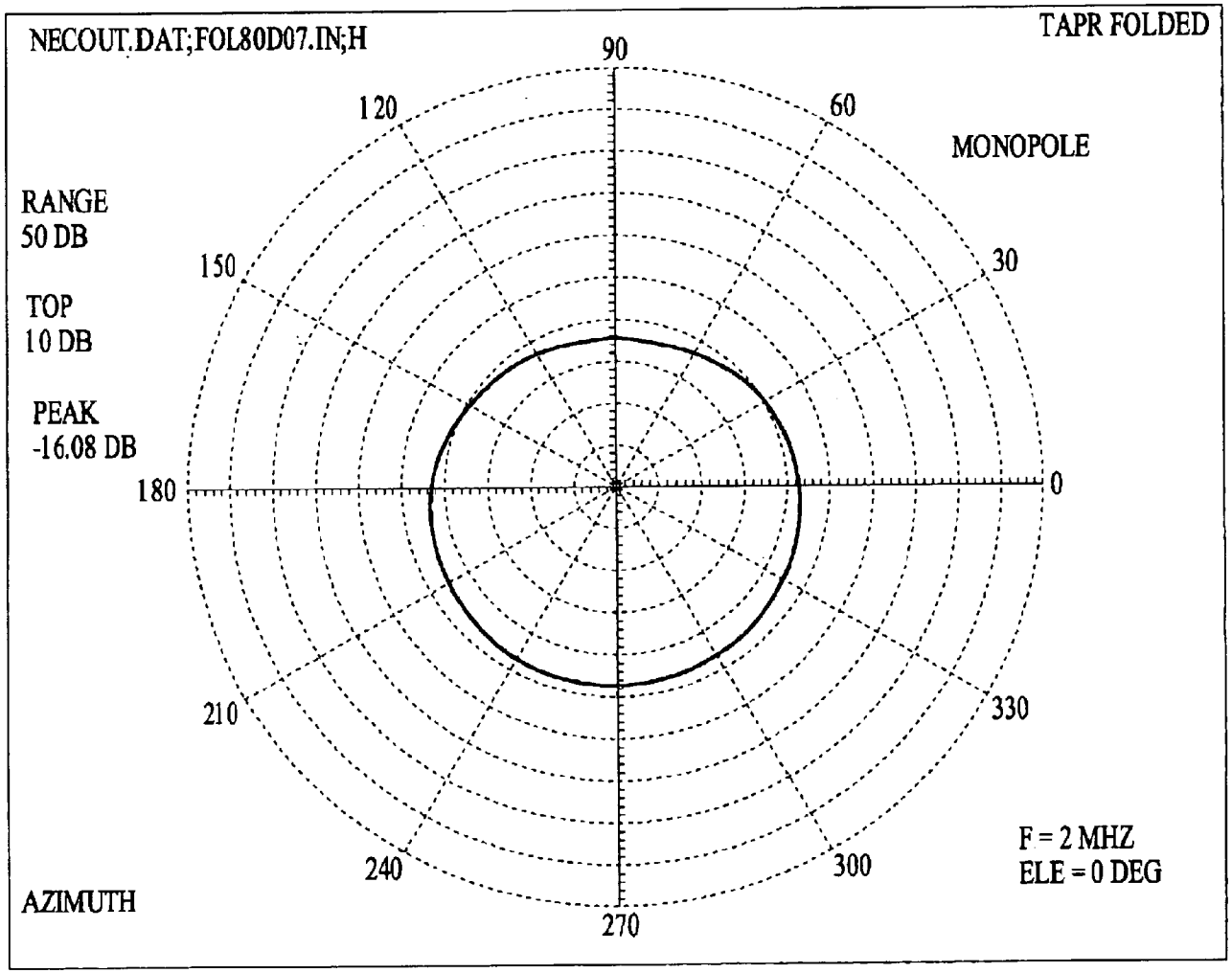
FIGS. 4A–4D illustrate the horizontal (azimuth) patterns calculated for one embodiment of the invention at 2, 10, 20 and 30 MHZ, respectively, at an elevation angle of zero degrees.
Figure 4B:
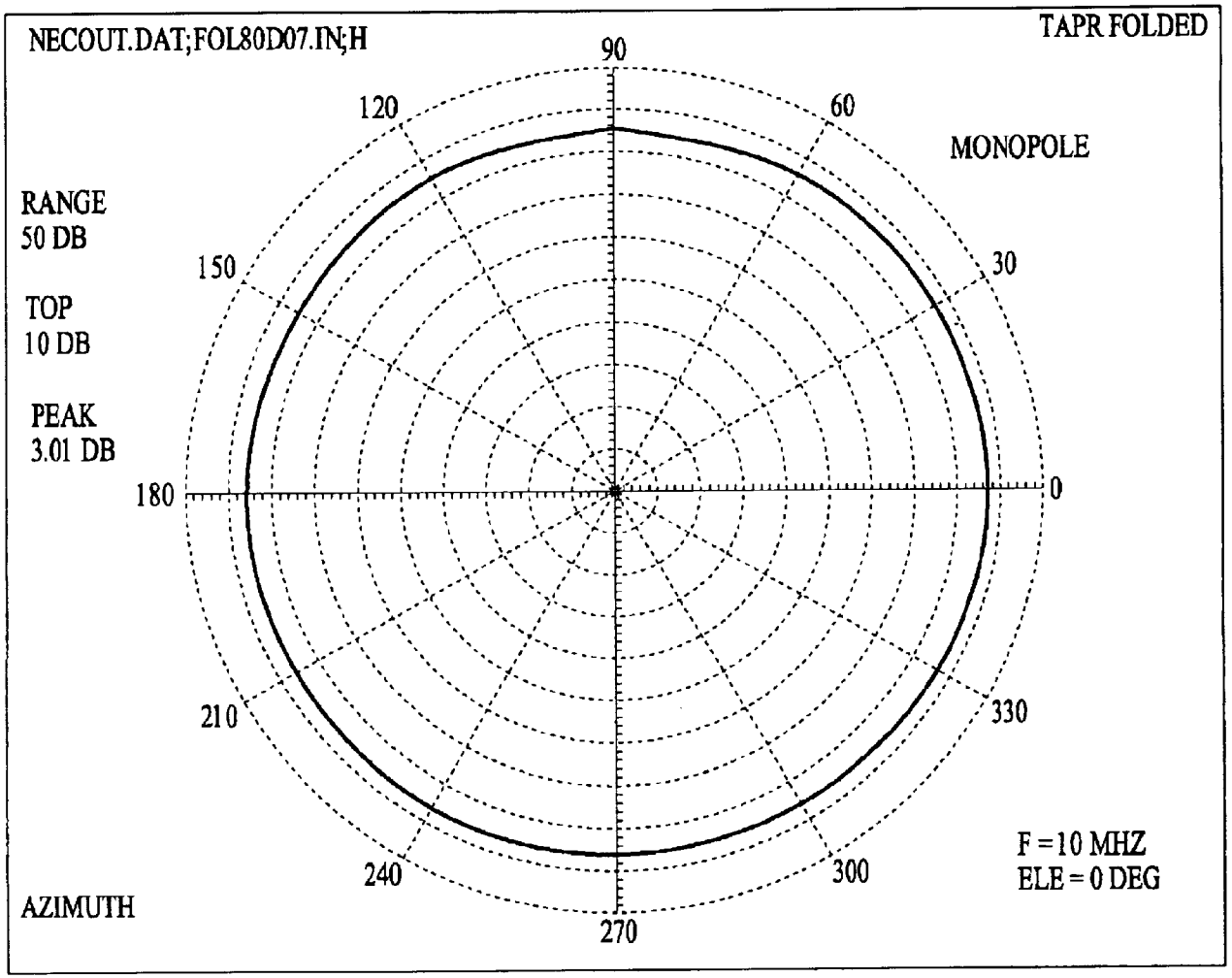
Figure 4C:
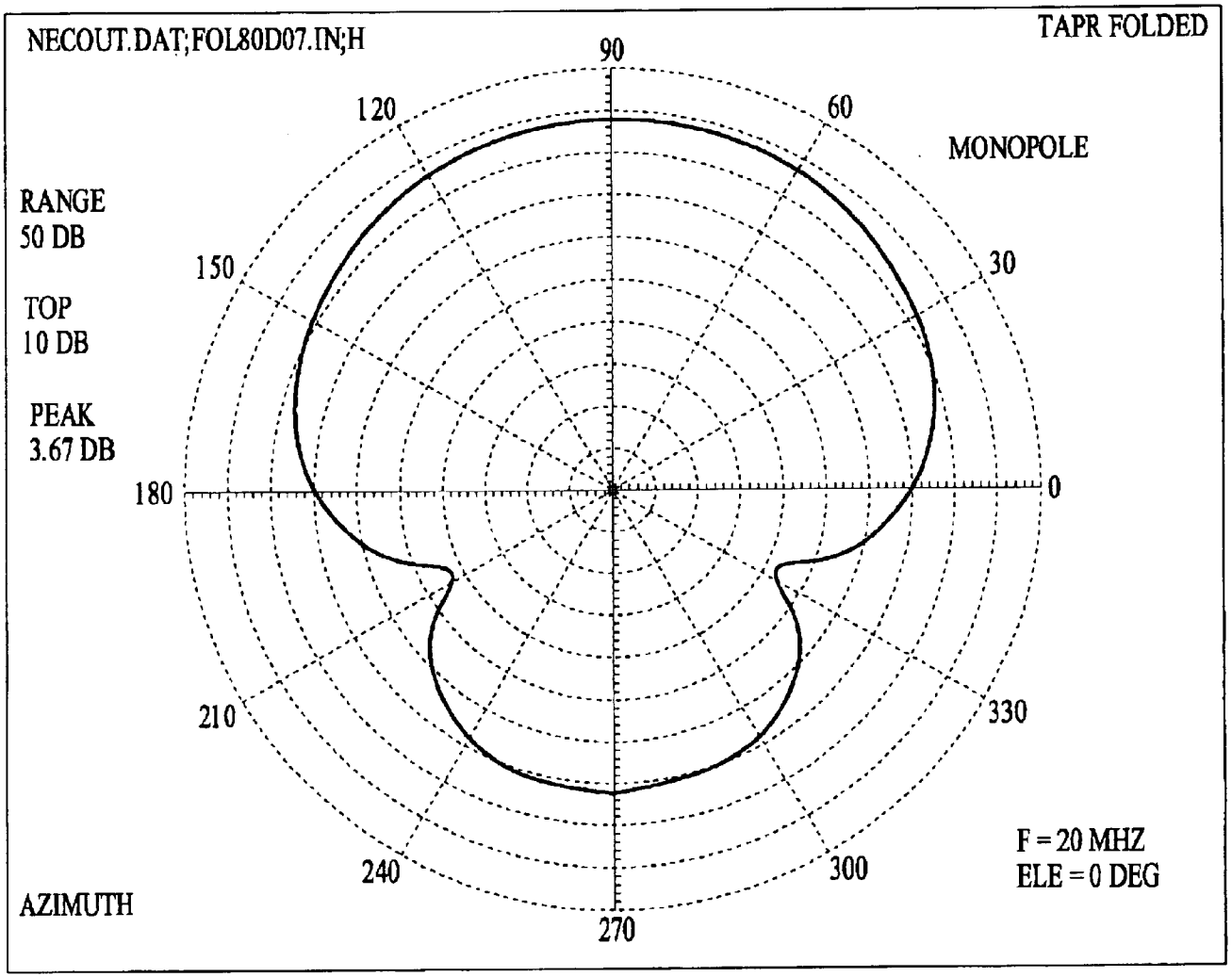
Figure 4D:
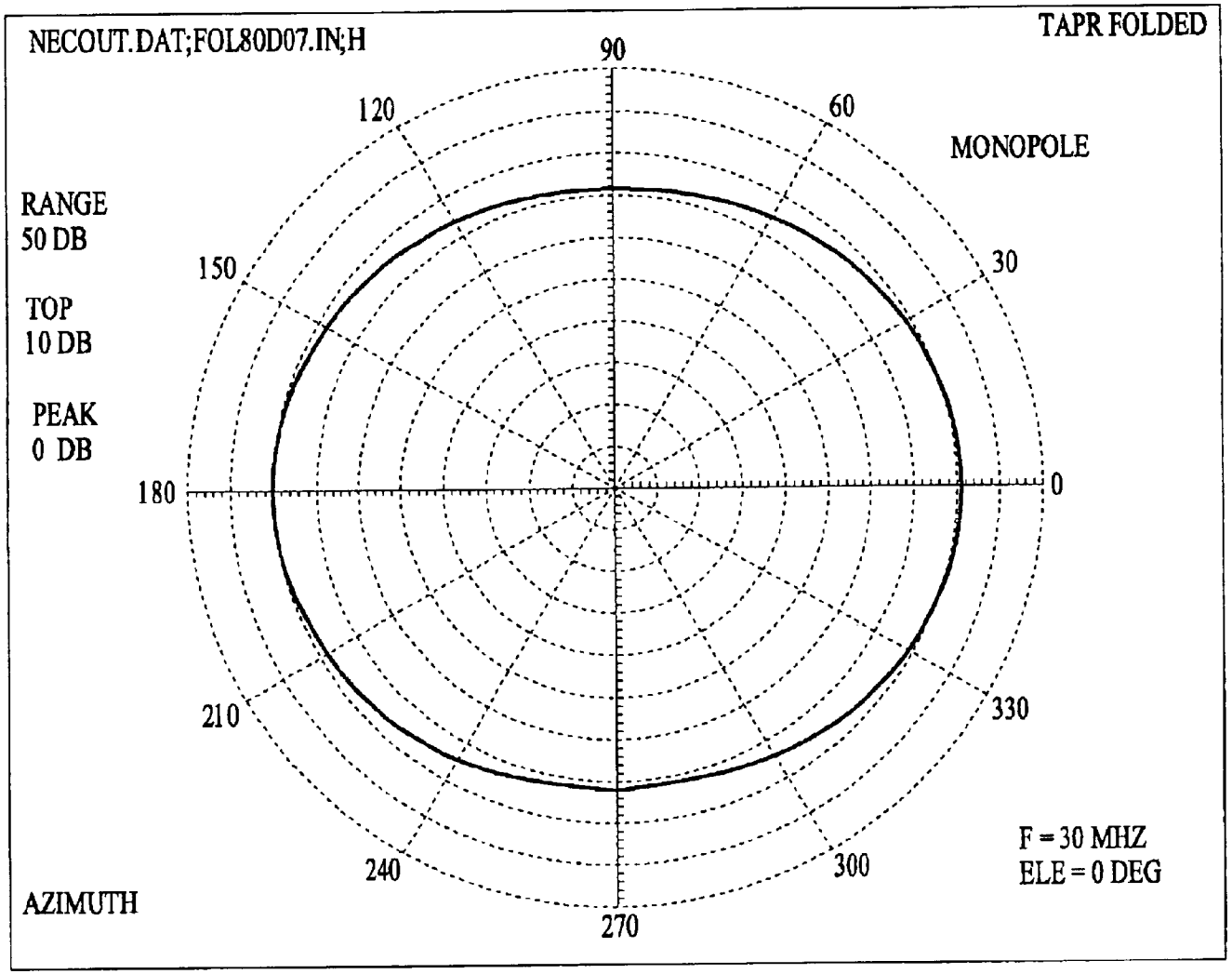
Figure 5A:
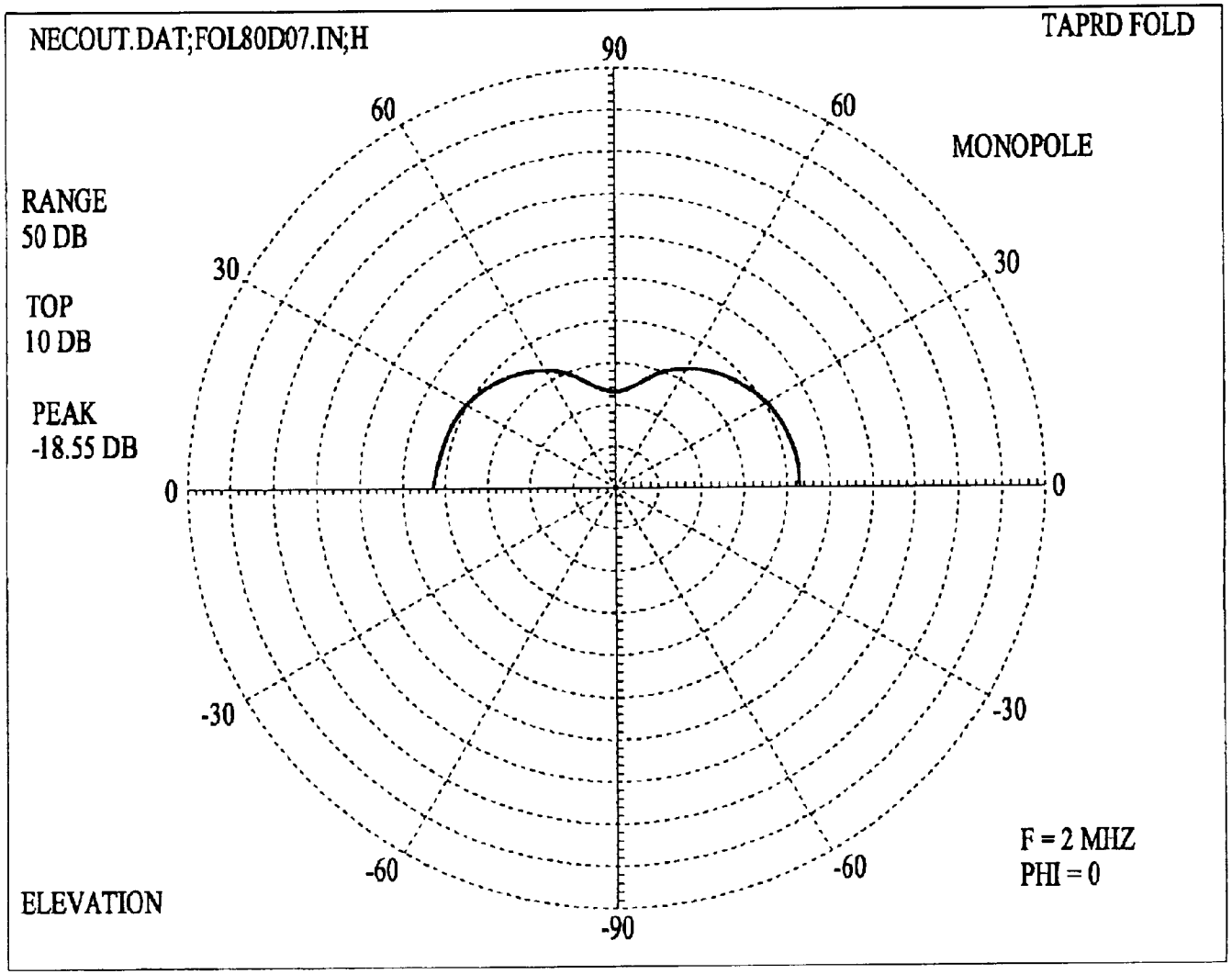
FIGS. 5A–5D illustrate the vertical (elevation) patterns calculated for one embodiment of the invention at 2, 10, 20 and 30 MHZ, respectively, at an azimuth angle of zero degrees.
Figure 5B:
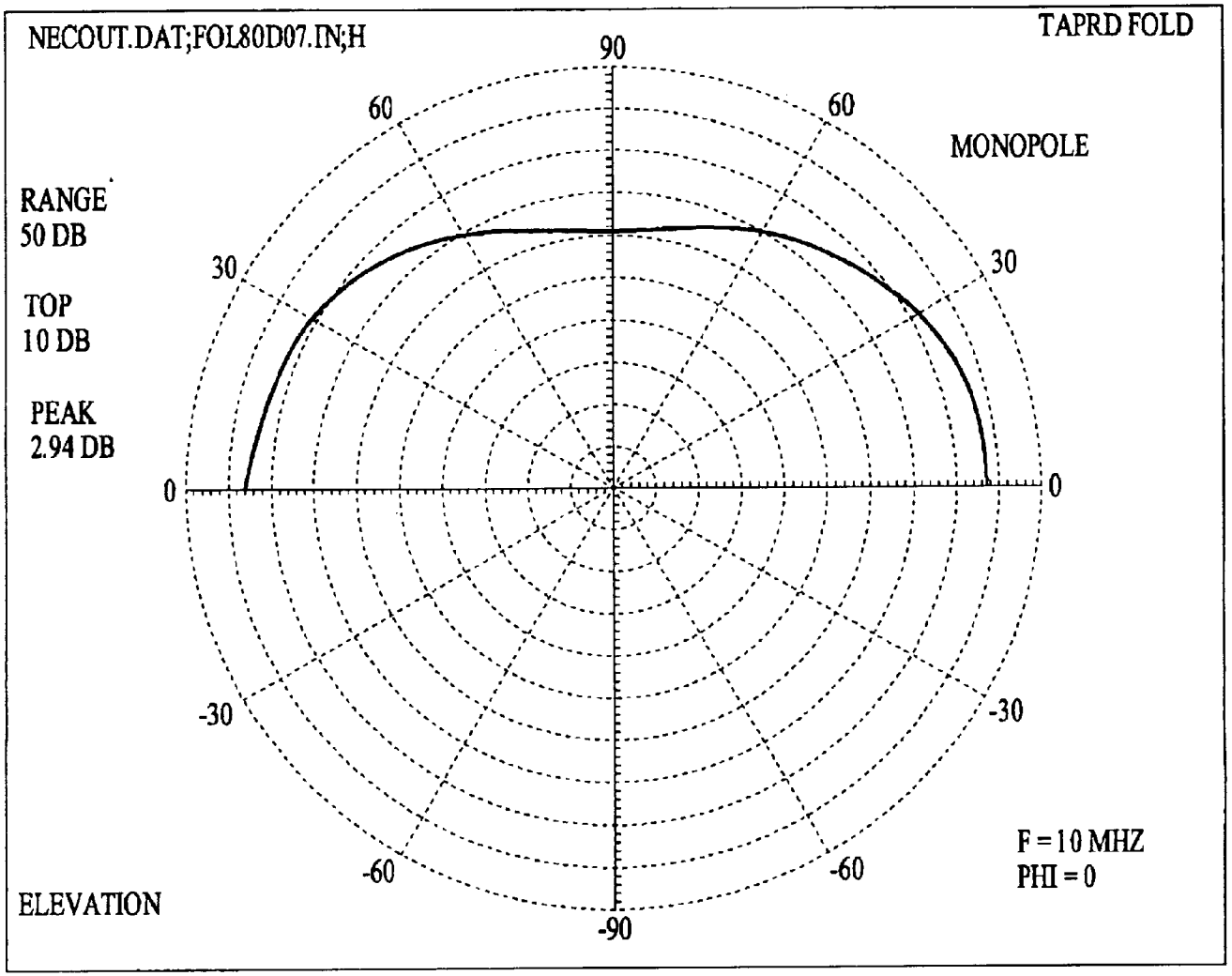
Figure 5C:
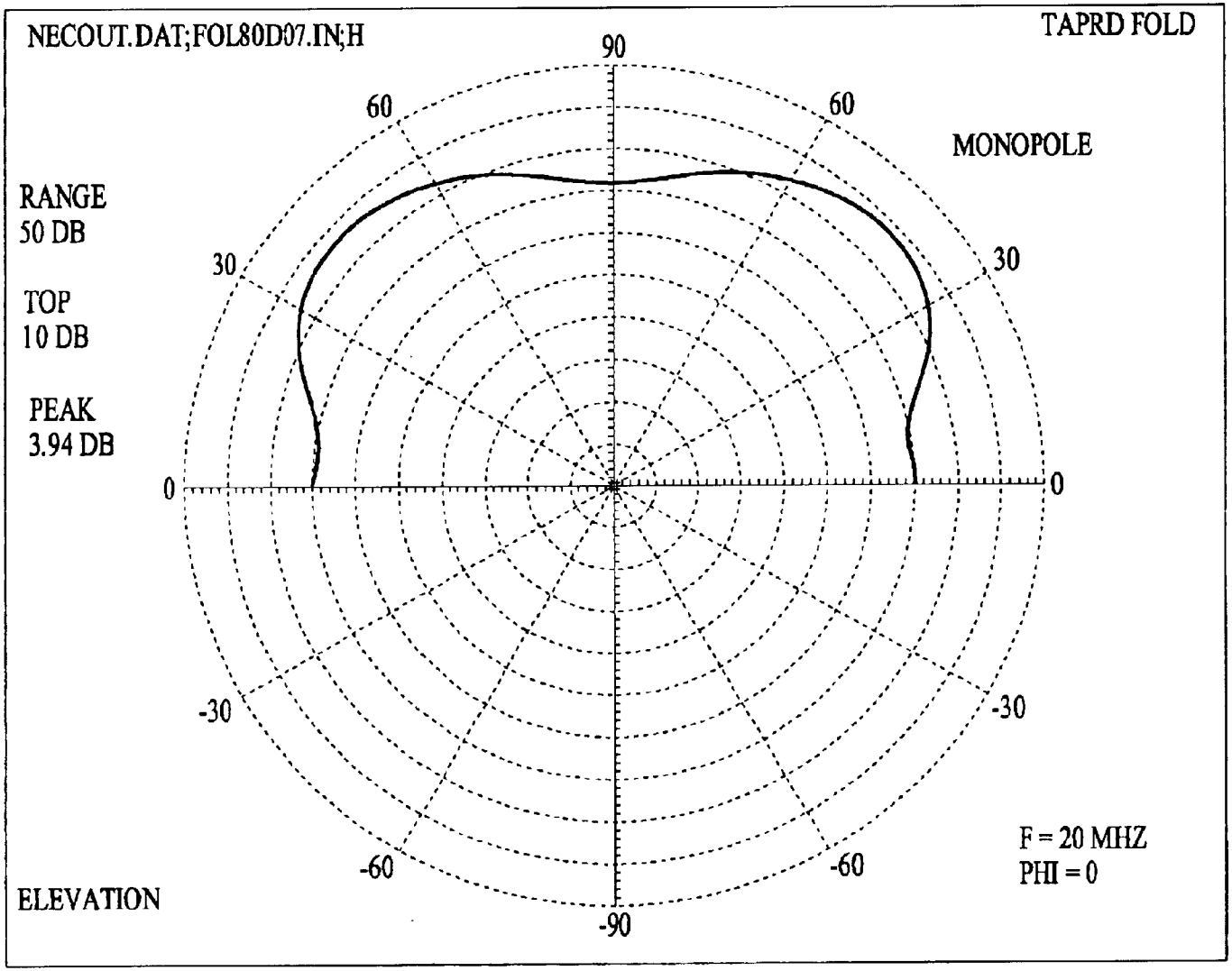
Figure 5D:
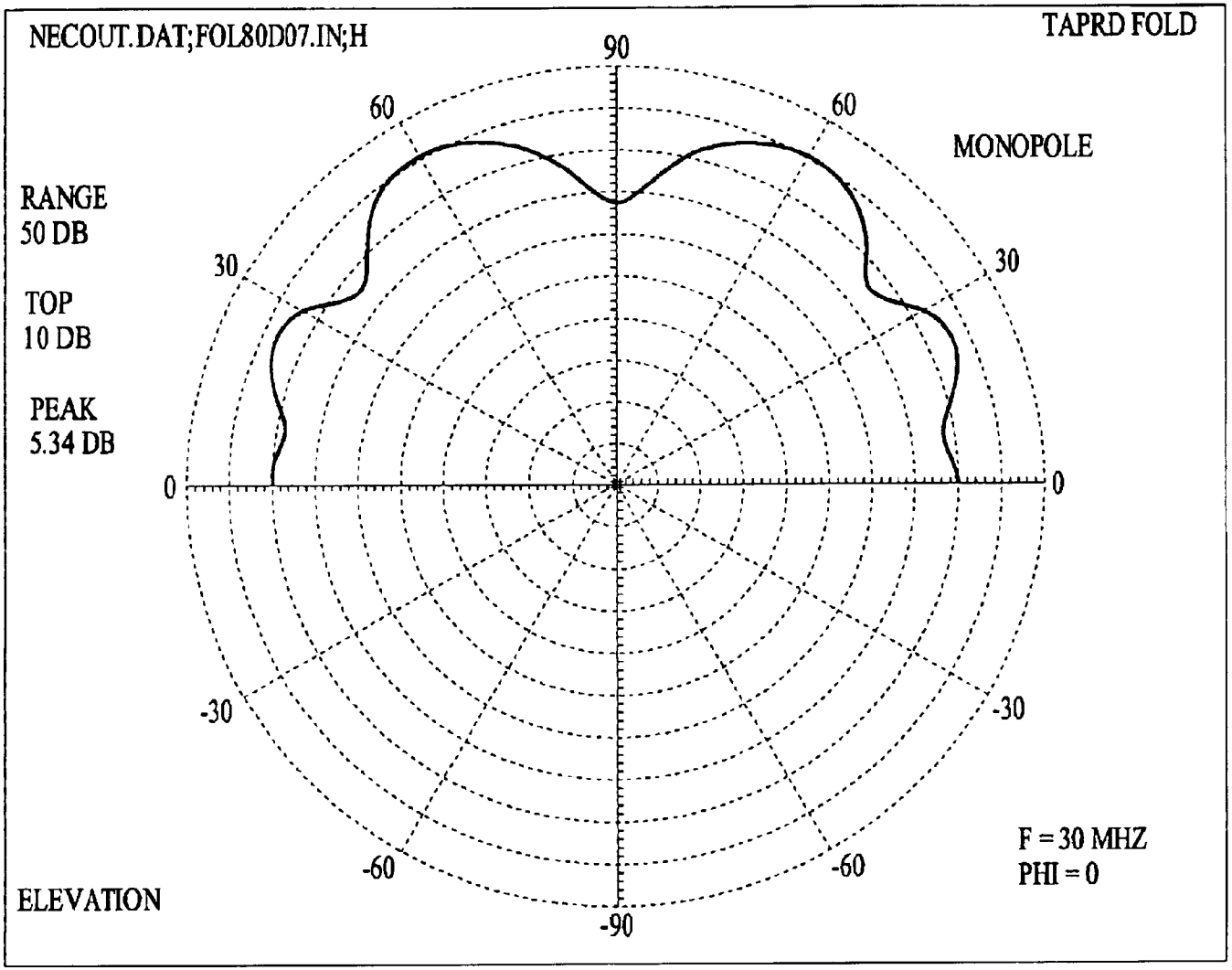
Figure 6A:
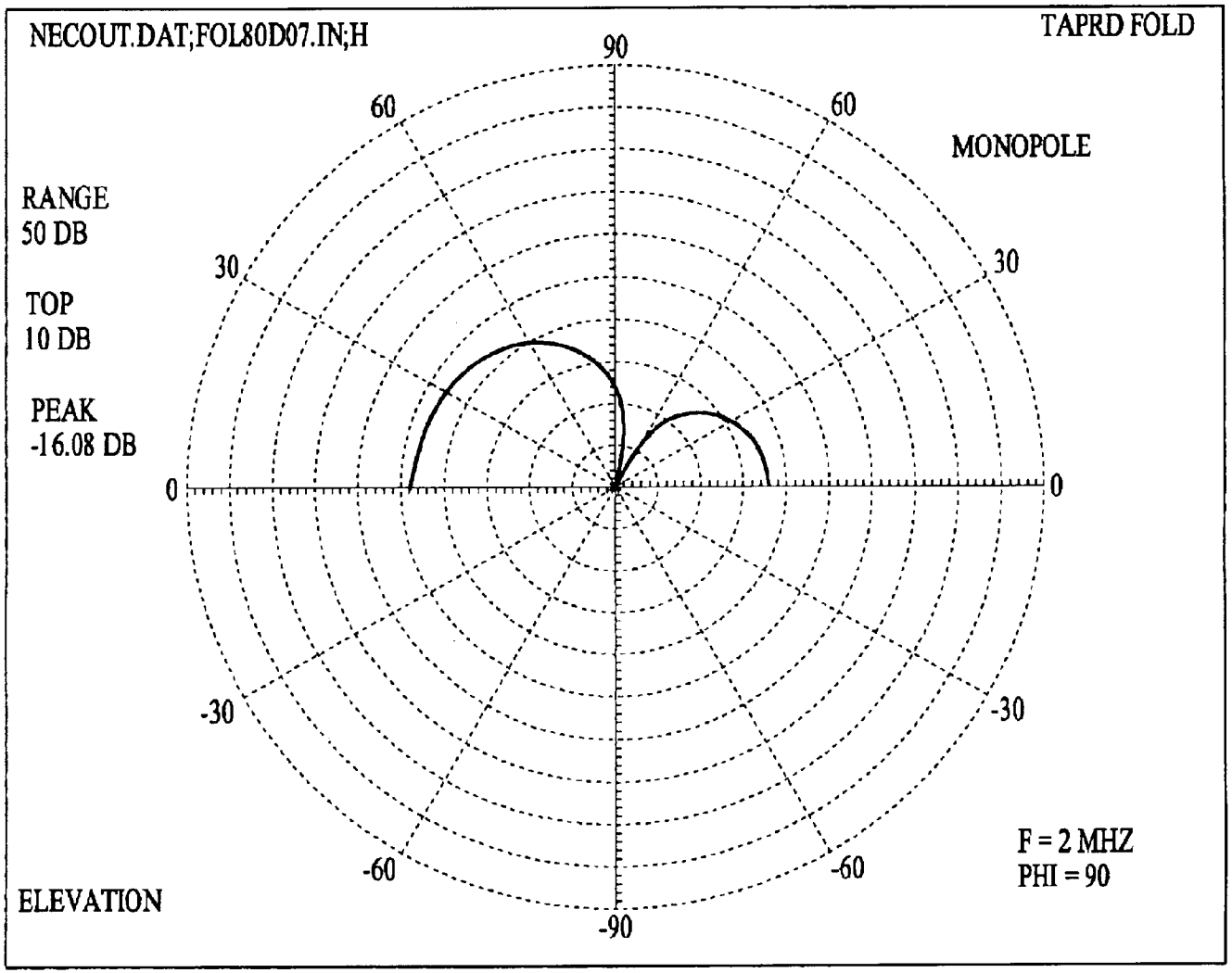
FIGS. 6A–6D illustrate the vertical (elevation) patterns calculated for one embodiment of the invention at 2, 10, 20 and 30 MHZ, respectively, at an azimuth angle of 90 degrees.
Figure 6B:
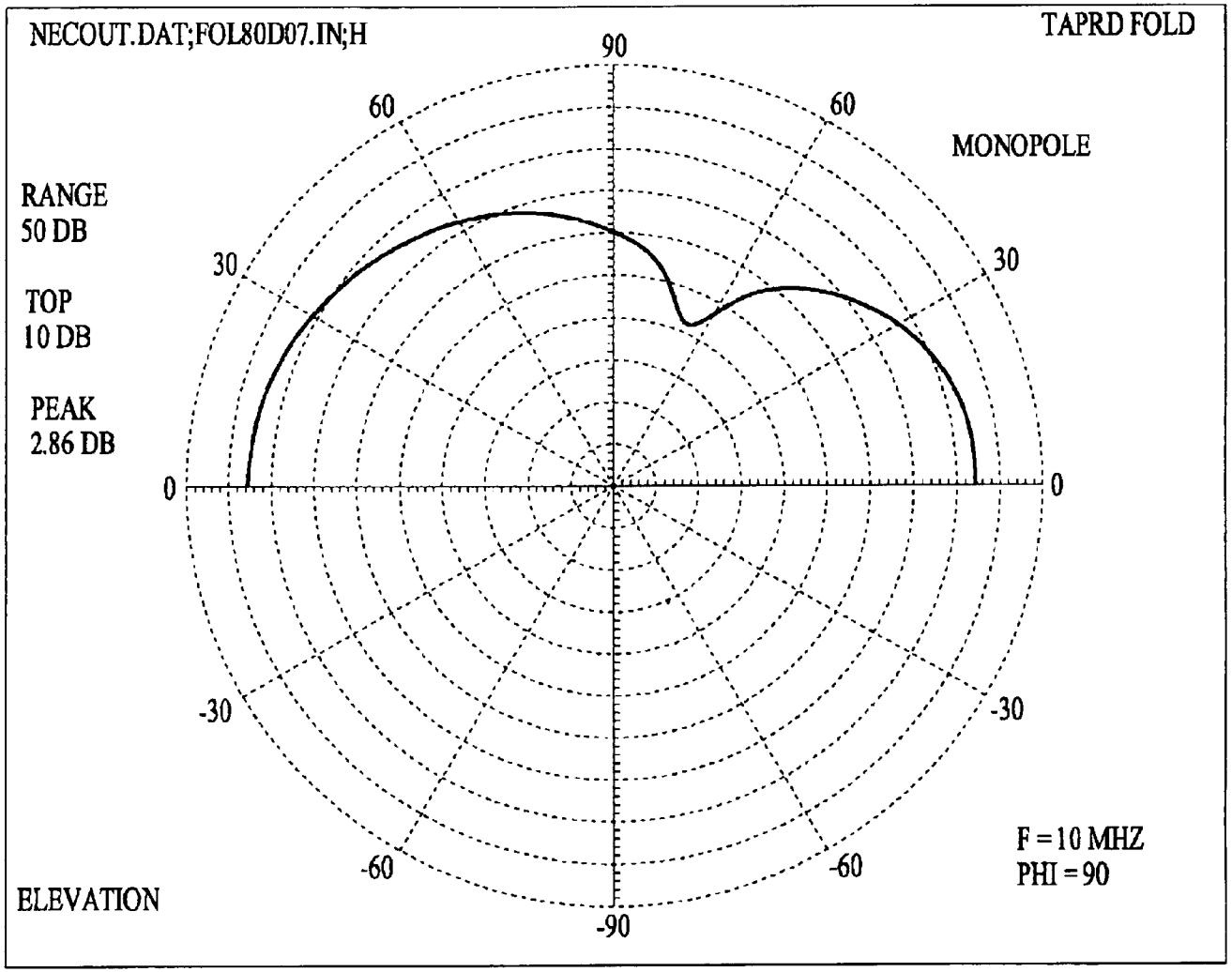
Figure 6C:
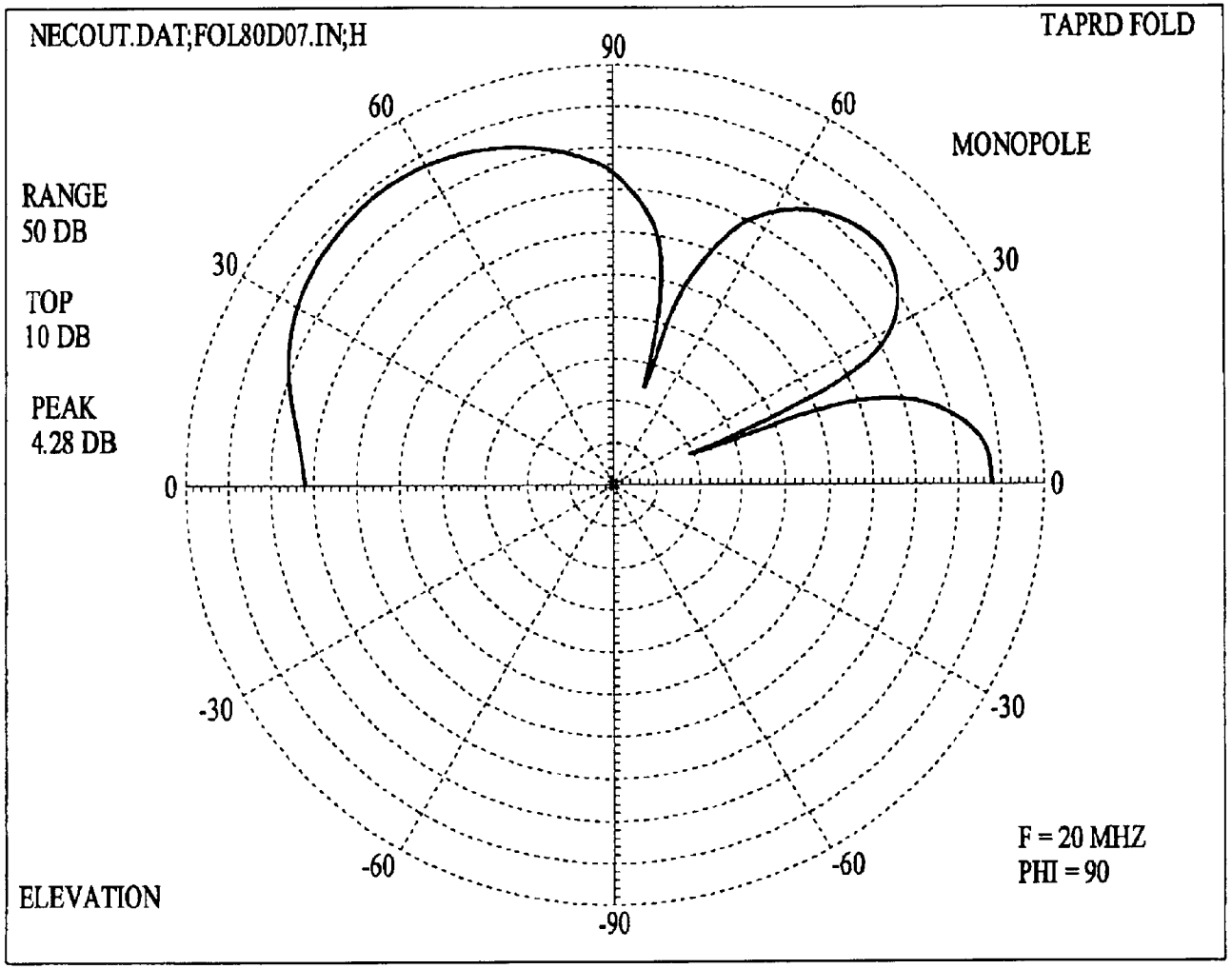
Figure 6D:
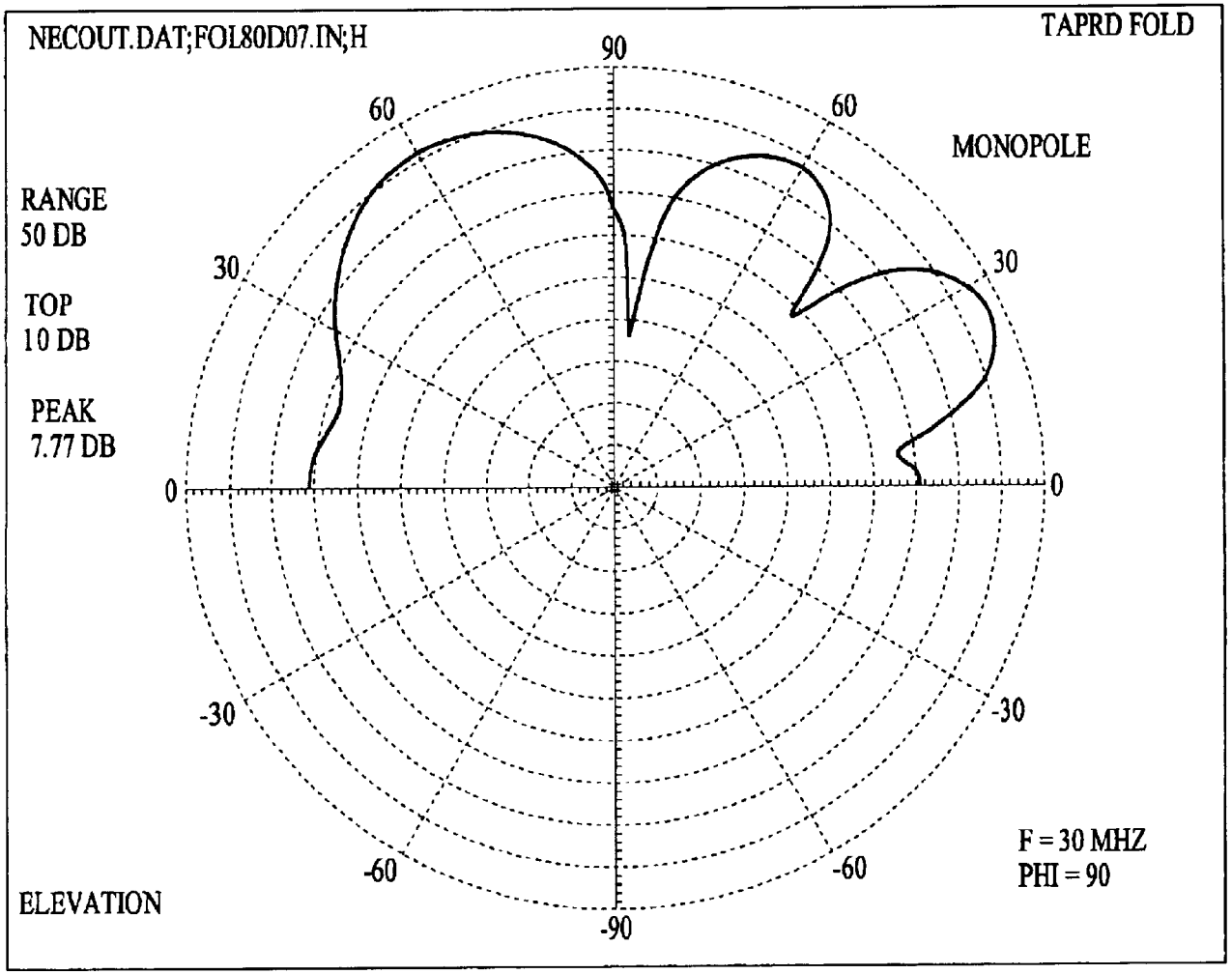

Referring to FIG. 3, the excellent VSWR performance of this representative antenna can be at the expense of antenna efficiency, especially at the lower frequencies between 2 and 5 MHZ, as shown. Between these frequencies, the efficiency is between 2% and 20%. However, above 5 MHZ, the efficiency increases rapidly and varies between 20% and 70%.

To evaluate antenna pattern performance, vertical and horizontal antenna patterns were computed. As shown in FIG. 4, the horizontal (azimuth) patterns were calculated at 2, 10, 20 and 30 MHZ at an elevation angle of zero degrees, as shown, respectively, in FIGS. 4A, 4B, 4C and 4D. As can be seen from these figures, the azimuth patterns of the folded, tapered monopole antenna of the invention are similar to patterns of a simple monopole antenna of the same height except at 20 MHZ. At FIG. 5, the vertical (elevation) patterns were calculated at 2, 10, 20 and 30 MHZ at an azimuth angle of zero degrees, as shown in FIGS. 5A, 5B, 5C and 5D, respectively, and at an azimuth angle of 90 degrees, as shown in FIGS. 6A, 6B, 6C and 6D. As can be seen from FIGS. 5 and 6, the vertical antenna patterns of the tapered, folded monopole antenna of the invention are similar to the vertical patterns of a simple monopole antenna of the same height.

Figure 7A:
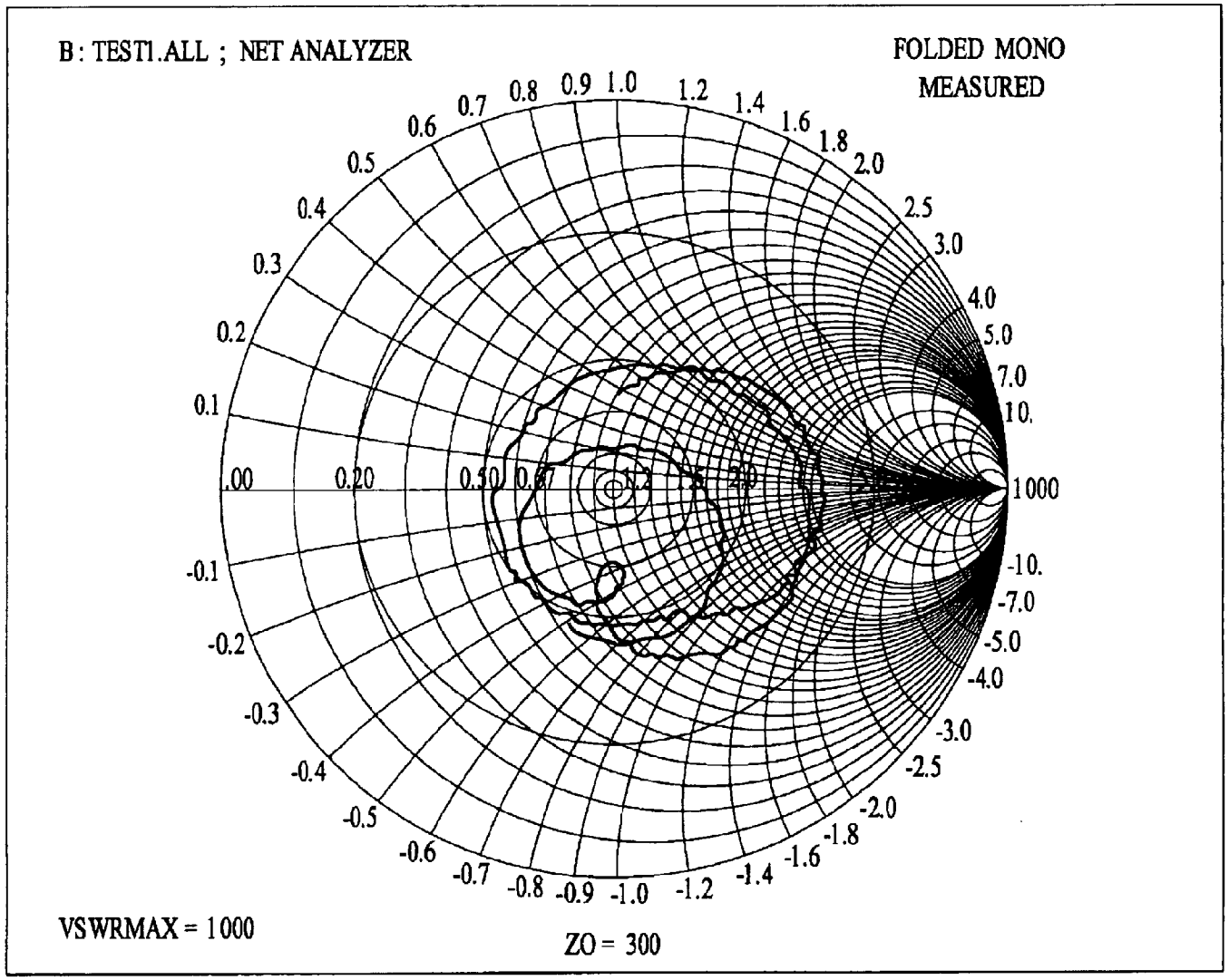
In FIGS. 7A and 7B, the measured antenna impedance (Smith Chart) and VSWR for the invention, as a function of frequency, are shown, respectively.
Figure 7B:
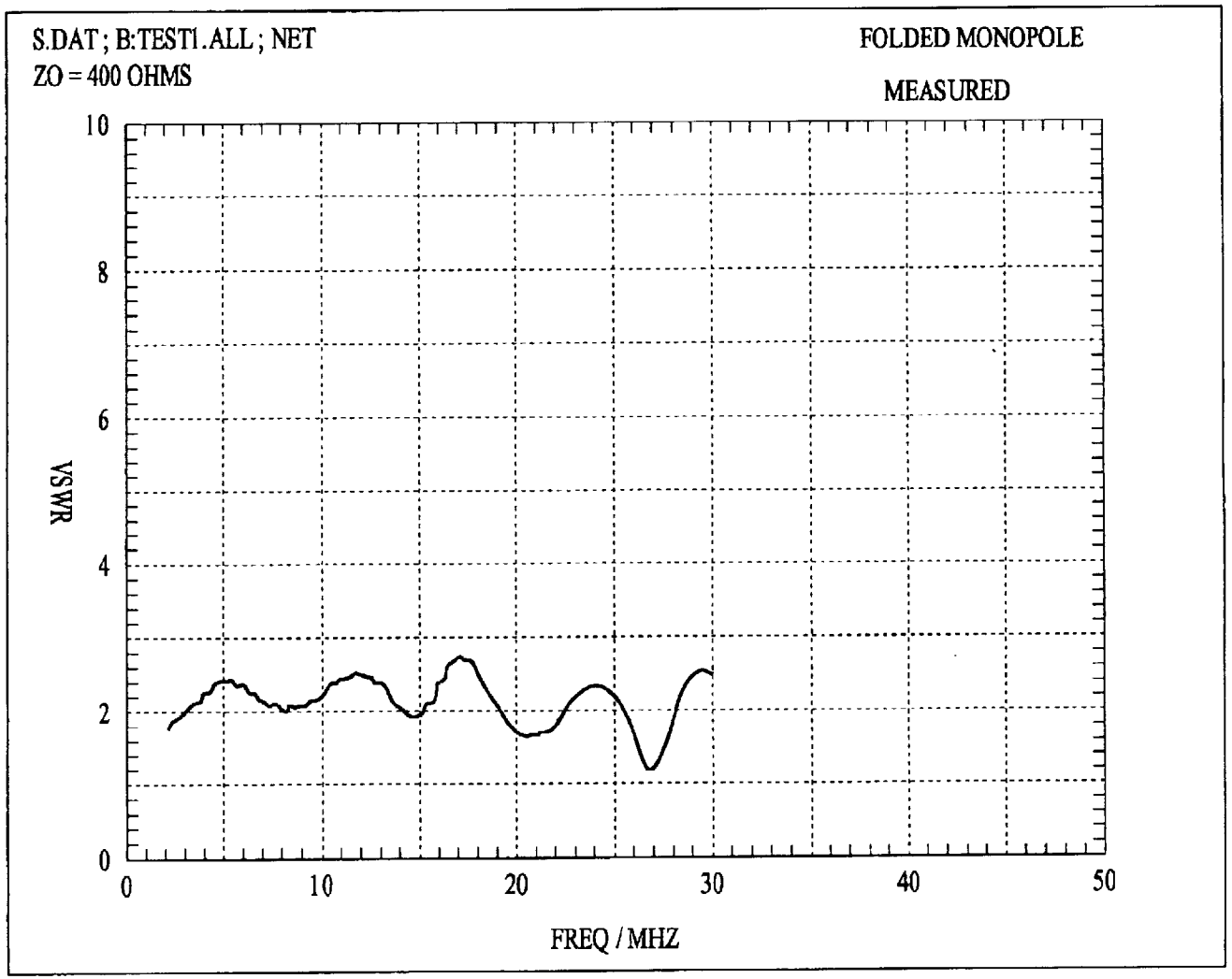

To verify the above computer computations, a 1/12 scale brass model was built and tested. The measured antenna impedance and VSWR, as a function of frequency, are shown in the Smith Chart of FIG. 7A and the VSWR of FIG. 7B. The measured results shown in FIG. 7 agree well with the calculated results shown in FIG. 2.

To verify the calculated antenna efficiency of the tapered, folded monopole antenna of the invention, the antenna was measured at 2 MHZ. Efficiency was measured by comparing the model antenna to an unloaded, vertical monopole antenna, resonant at 2 MHZ. Measured efficiency was 1.9%, which compares well with the computed value of 2%.

The antenna design of the invention provides transmitter impedance matching over the entire high frequency band. This is accomplished without the need for an array of matching circuits and associated switching networks. The antenna of the invention is designed to require no matching circuit at all, only a simple loading. Though an exemplary embodiment of the invention has been disclosed herein, the design parameters of the antenna, such as width, height or material may be varied for a wide variety of antenna applications, whether these be land-based or shipboard. Further, though the invention has been described as utilizing a stepwise tapered monopole element, this element could also be of a continuous taper. The resistive load as described may be altered (decreased) to improve the antenna's efficiency if a higher VSWR is acceptable. Other arrangements of network elements could also be used, for example, a multiple loading, involving RLC component to further optimize VSWR and efficiency.

Obviously, many modifications and variations of the invention are possible in light of the above teachings. It is therefore to be understood that within the scope of the appended claims the invention may be practiced otherwise than as has been specifically described.

What is claimed is:

1. An antenna apparatus comprising:

a first monopole antenna element having an outer diameter that varies between a base end thereof and a top end thereof;

a second monopole antenna element having an outer diameter that is substantially constant between a base end thereof and a top end thereof; and a third antenna element having an outer diameter that is substantially equal to said outer diameter of said second monopole antenna element, said third antenna element being operably coupled to said top ends of said first and second monopole antenna elements.

2. An apparatus according to claim 1 in which said outer diameter of said first monopole antenna element decreases between said base end thereof and said top end thereof.

3. An apparatus according to claim 2 in which an antenna feed is operably coupled to said second monopole antenna.

4. An antenna according to claim 3 in which a resistive loading is operably coupled to said base end of said first monopole antenna and to a ground plane, in which said base end of said first monopole antenna is electrically isolated from said ground plane.

5. An apparatus according to claim 1 in which said first monopole antenna element includes a series of operably coupled cylindrical sections extending from said base end thereof to said top end thereof, said cylindrical sections decreasing in diameter from said base end to said top end.

6. An apparatus according to claim 5 in which an antenna feed is operably coupled to said base end of said second monopole antenna.

7. An antenna according to claim 6 in which a resistive loading is operably coupled to said base end of said first monopole antenna and to a ground plane, in which said base end of said first monopole antenna is electrically isolated from said ground plane.

8. A folded monopole antenna apparatus comprising:

a first substantially vertical monopole antenna element having an outer diameter that decreases between a base end thereof and a top end thereof;

a second substantially vertical monopole antenna element having an outer diameter that is substantially constant between a base end thereof and a top end thereof, said second substantially vertical monopole antenna element horizontally spaced apart from said first substantially vertical monopole antenna element; and a third antenna element having an outer diameter that is substantially equal to said outer diameter of said second monopole antenna element, said third antenna element being operably coupled to said top ends of said first and second monopole antenna elements.

9. An apparatus according to claim 8 in which said first monopole antenna element includes a series of operably coupled cylindrical sections extending from said base end thereof to said top end thereof, said cylindrical sections decreasing in diameter from said base end to said top end.

10. An apparatus according to claim 9 in which an antenna feed is operably coupled to said base end of said second monopole antenna.

11. An antenna according to claim 10 in which a resistive loading is operably coupled to said base end of said first monopole antenna and to a ground plane, in which said base end of said first monopole antenna is electrically isolated from said ground plane.

12. A folded monopole antenna apparatus comprising:

a first substantially vertical monopole antenna element having a series of operably coupled cylindrical sections extending from a base end thereof to a top end thereof, said cylindrical sections decreasing in diameter from said base end to said top end so that a cylindrical section at said base end has a diameter that is larger than a diameter of a cylindrical section at said top end;

a second substantially vertical monopole antenna element having an outer diameter that is substantially constant between a base end thereof and a top end thereof and that is of equal diameter to said diameter of said cylindrical section at said top end of said first substantially vertical monopole antenna element, said second substantially vertical monopole antenna element horizontally spaced apart from said first substantially vertical monopole antenna element; and a third substantially horizontal antenna element having an outer diameter that is substantially equal to said outer diameter of said second monopole antenna element, said third antenna element being operably coupled to said top ends of said first and second monopole antenna elements.

13. An apparatus according to claim 12 in which an antenna feed is operably coupled to said base end of said second monopole antenna.

14. An antenna according to claim 13 in which a resistive loading is operably coupled to said base end of said first monopole antenna and to a ground plane, in which said base end of said first monopole antenna is electrically isolated from said ground plane.

* * * * *